United States Patent [19]

Seibel et al.

[11] 4,339,520

[45] Jul. 13, 1982

[54] LIGHT-SENSITIVE VESICULAR MATERIAL

[75] Inventors: Markus Seibel, Mainz; Bernd Huber; Irmgard Bindrum, both of Wiesbaden; Dieter Bodenheimer, Aarbergen, all of Fed. Rep. of Germany

[73] Assignee: Hoechst Aktiengesellschaft

[21] Appl. No.: 249,436

[22] Filed: Mar. 31, 1981

[30] Foreign Application Priority Data

Apr. 16, 1980 [DE] Fed. Rep. of Germany ..... 3014538

[51] Int. Cl.[3] ..... G03C 1/60; G03C 1/72; G03C 1/76

[52] U.S. Cl. ..... 430/155; 430/152; 430/157; 430/175; 430/176; 430/192; 430/197; 430/270; 430/271; 430/290; 430/330; 430/907

[58] Field of Search ..... 430/175, 176, 152, 290, 430/192, 197, 907, 155, 157, 270, 271, 330

[56] References Cited

U.S. PATENT DOCUMENTS

| | | | |
|---|---|---|---|
| 3,032,414 | 5/1962 | James et al. | 430/152 |
| 3,161,511 | 12/1964 | Parker et al. | 96/49 |
| 3,620,743 | 11/1971 | Notley | 96/49 |
| 3,622,336 | 11/1971 | Notley | 96/91 |
| 3,661,589 | 5/1972 | Notley | 96/91 |

FOREIGN PATENT DOCUMENTS

| | | |
|---|---|---|
| 2609655 | 3/1976 | Fed. Rep. of Germany . |
| 1309575 | 3/1973 | United Kingdom . |
| 1483641 | 8/1977 | United Kingdom . |

*Primary Examiner*—Charles L. Bowers, Jr.
*Attorney, Agent, or Firm*—Schwartz, Jeffery, Schwaab, Mack, Blumenthal & Koch

[57] ABSTRACT

A light-sensitive vesicular recording material comprising a support and a layer comprised of a binder and a light-sensitive compound applied to the support, said binder comprising a butanone soluble copolymer of methacrylonitrile and vinylidene chloride; particularly, a mixture of a butanone soluble methacrylonitrile/-vinylidene chloride copolymer and a vinylidene chloride/acrylonitrile copolymer, said copolymers being miscible with each other in butanone.

21 Claims, No Drawings

LIGHT-SENSITIVE VESICULAR MATERIAL

BACKGROUND OF THE INVENTION

The present invention relates to a light-sensitive recording material for use in the vesicular process comprising a layer which is composed of a binder and a light-sensitive compound and is applied to a suitable support.

Recording materials for the production of vesicular images are known in the art. They comprise a layer of a thermoplastic resin and, dispersed therein, a light-sensitive compound which decomposes and generates gas when it is exposed to light. The light-sensitive layer is applied to a support. Upon exposure through an original, the light-sensitive compounds contained in the layer are decomposed according to the image of the original. The film is developed by heating it up to at least the glass transition temperature of the thermoplastic resin so that softening occurs and the photolytically produced gas which is enclosed in the binder, expands and forms bubbles. These bubbles reflect and refract light thereby making an image visible under suitable optical conditions.

It is known to use gelatin as a binder (German Pat. No. 559,795), but this has proved to be rather impractical, because although gelatin has a very high impermeability to gas, its resistance to moisture or water is extremely poor. Under the action of moisture, gelatin softens and the initially present bubbles and, consequently, also the image collapse and disappear.

Therefore, synthetic, thermoplastic, gas-tight polymers which are not sensitive to water have been disclosed for use a binders (German Pat. No. 1,155,329), but these films show, among other defects, an insufficient thermal image stability. It is also known (U.S. Pat. No. 3,161,511) to use polymethacrylonitrile as the binder in order to improve on the thermal image stability. This polymer, however, has the disadvantage of poor film forming characteristics on conventional support materials.

Further improvements of the binder materials have also been disclosed. They are directed at combining the good properties of polymethacrylonitrile, such as photographic sensitivity, with the good properties of other resins. According to U.S. Pat. No. 3,622,336 such copolymers which have thus been developed comprise, for example, different vinyl monomers which are copolymerizable with methacrylonitrile and are compatible with other organic, film-forming substances. Compared with methacrylonitrile homopolymers these vesicular materials have improved physical properties, but they do not show the high-grade utilization of gas. In addition, these systems have proved to be relatively incompatible.

The imcompatibility of methacrylonitrile copolymers in mixtures with other resins which are normally employed for the production of vesicular films is described in detail in U.S. Pat. No. 3,661,589. This patent discloses two-phase systems of hydrophobic resins which, due to the interphases present in the binder, are intended to give an increased image density. For this purpose, for example, a mixture is used of a methacrylonitrile/methylmethacrylate copolymer with an acrylonitrile/vinylidene chloride copolymer in a weight ratio of 2:1, and the incompatibility of these copolymers with one another is emphasized. The copies produced according to this teaching show an undesirably strong fogging.

It has further been attempted (German Auslegeschrift No. 2,061,464) to combine the thermal image stability of polymethacrylonitrile with the good properties, such as film formation, of other resins, for example, by copolymerizing α-chloroacrylonitrile with methacrylonitrile and/or by mixing such a copolymer with other resins. Films produced in this way show a relatively high utilization of gas, but have a marked susceptibility to scratching of the film surface, which is not acceptable in high resolution microfilms.

It is also known (German Offenlegungsschrift No. 2,044,387) to use copolymers of methacrylonitrile with ethylenically unsaturated acids, esters, nitriles or the like, as binders for the light-sensitive compound. Films produced with these binders, however, either exhibit an inferior utilization of gas or a film formation which does not meet technical requirements.

German Offenlegungsschrift No. 2,438,157 describes mixtures of polymethacrylonitrile homopolymer with other resins, for example, with a vinylidene chloride/acrylonitrile copolymer. It is pointed out that, contrary to the teachings of the prior art, compatible mixtures with other polymers can be obtained, but this compatibility can only exist within narrow limits because complicated solvent mixtures must be employed, which, in part, are toxic or very enviromentally undesirable, such as tetrahydrofuran, dioxane or acetonitrile.

SUMMARY OF THE INVENTION

Accordingly, it is an object of the present invention to provide a light-sensitive recording material for use in the vesicular process.

Another object of the present invention is to provide a vesicular recording material which is stable toward moisture.

A further object of the present invention is to provide a vesicular recording material comprising a binder which exhibits a relatively high softening temperature.

Another object of the present invention is to provide a vesicular recording material which has a good thermal image stability.

It is also an object of the present invention to provide a vesicular recording material comprising a binder layer which adheres well to conventional support materials.

A still further object of the present invention is to provide a vesicular recording material comprising a binder which exhibits good film forming characteristics.

Yet another object of the present invention is to provide a vesicular recording material comprising a binder which exhibits high gas impermeability.

An additional object of the present invention is to provide a vesicular recording material which exhibits high grade utilization of gas.

As still further object of the present invention is to provide a vesicular recording material made of substances which are compatible with each other.

Another object of the present invention is to provide a vesicular recording material which yields a high image density.

It is also an object of the present invention to provide a vesicular recording material which exhibits good transparency.

Still another object of the present invention is to provide a vesicular recording material which minimizes fogging.

A further object of the present invention is to provide a vesicular recording material with good resistance to scratching.

Another object of the present invention is to provide a vesicular recording material which can be produced without the use of toxic or ecologically unacceptable solvent mixtures.

Another object of the present invention is to provide a vesicular recording material comprising a binder which is soluble in a single solvent.

It is also an object of the present invention to provide a vesicular recording material which is acceptable for high resolution microfilms.

These and other objects of the invention are achieved by providing a light-sensitive vesicular recording material comprising a support and a layer on said support comprising a binder having a light-sensitive compound decomposing to generate a gas when exposed to light, and said binder comprising a copolymer of methacrylonitrile and vinylidene chloride soluble in butanone.

In further aspects of the invention, a mixture of from about 80 to about 40 weight percent of a copolymer of methacrylonitrile and vinylidene chloride and of from about 20 to about 60 weight percent of a copolymer of vinylidene chloride and acrylonitrile are used as the binder; said copolymers being miscible with each other in butanone, said copolymer of methacrylonitrile and vinylidene chloride comprising from about 40 to about 80 weight percent methacrylonitrile and having a glass transition temperature (Tg) in the range from about 80 to about 130° C., and a solution viscosity less than about 50 mPa.s (i.e., 50 milli-Pascalseconds, corresponding to 50 centipoises), perferably from about 2.5 to about 30 mPa.s, and most perferably from about 5 to about 15 mPa.s.

An important aspect of the invention is that the copolymer of methacrylonitrile and vinylidene chloride is soluble in butanone. This solvent is also commonly referred to as methyl ethyl ketone. For convenience, in the following description the term butanone with be used.

As a result of the present invention, a highly light-sensitive recording material for the vesicular method is provided which does not require any after-treatment with water vapor or the like and has a high resolving power. The binder used has as a good film forming capacity and, at the same time, a good adhesion to the support. The film surface exhibits good scratch resistance. Due to the excellent compatibility of its constituents, the material is highly transparent. In addition, the recording material shows a very good utilization of gas. due to its high impermeability to gas.

Surprisingly, it was found that the recording material, even at a relatively large total proportion of vinylidene chloride, has a good thermal image stability which satisfies technical requirements. The possibilty of forming hydrogen chloride by decomposition of the vinylidene chloride can be inhibited by addition of stabilizers (e.g., IRGASTAB®—T9 of Ciba-Geigy, Basel, Switzerland)

DETAILED DESCRIPTION OF PREFERRED EMBODIMENTS

The support can be transparent, translucent or opaque; colored or colorless. Suitable supports include, for example, synthetic polymer films, such as, polyethylene or polypropylene films, preferably polyethylene therephthalate films. The support may also comprise paper, metal foils or plates, glass plates or the like. To improve adhesion, a primer may be applied to the support.

The copolymer of methacrylonitrile and vinylidene chloride can be prepared according to any of the known processes. For technical reasons, the polymerization is preferably effected in solution because in this manner recrystallization and drying are avoided. The proportion of methacrylonitrile in the copolymer is preferably from 80 to 40 weight percent. The glass transition temperature (Tg) of the copolymer ranges between about 80° C. and about 130° C.; the term "glass transition temperature" being defined according to "Polymer Handbook" by J. Brandrup and E. H. Immergut, 2nd edition, page III 139 et seq., John Wiley, New York (1975).

The copolymer of methacrylonitrile and vinylidene chloride can be used alone as the binder. Preferably, however, it is mixed with a vinylidene chloride/acrylonitrile copolymer which is soluble in butanone. In such a case the solution of the vinylidene chloride/acrylonitrile copolymer is miscible in any proportion with a solution of the copolymer of methacrylonitrile and vinylidene chloride.

It has proved advantageous for the copolymer of methacrylonitrile and vinylidene chloride to have, measured in a 20% solution in butanone at 20° C., a viscosity of less than 50 mPa·s, preferably of between about 2.5 and 30 mPa·s. Especially preferred copolymers have a viscosity in the range from about 5 to 15 mPa·s.

The mixing ratios of the two copolymers depend, to a large extent, on the properties which are intended to be imparted to the recording material of the invention. Thus, the pure methacrylonitrile/vinylidene chloride copolymer can be used in cases in which it is particularly important to have a high thermal image stability, even at a low developing temperature. On the other hand, by mixing in small amounts of the vinylidene chloride/acrylonitrile copolymer, the exposure time is reduced and will not be substantially changed any more by further additions. If, however, the proportion of the vinylidene chloride/acrylonitrile copolymer in the binder mixture becomes to high, thermal image stability deteriorates to a degree which for practical purposes is unacceptable. In view of the thermal image stability, a total proportion of about 60% by weight of vinylidene chloride can be specified as the upper limit.

By intensive drying, the layers can be hardened. In this way, the developing temperature required to achieve a sufficient density is raised, depending on the degree of hardening, from 90° C. up to 110° C. or above, but the thermal image stability still proves good, even in those mixtures in which it already decreases below a practically usable value in the case of unhardened layers. In hardened layers, the exposure time is not reduced by increasing amounts of the vinylidene chloride/acrylonitrile copolymer. From these results it follows that there is a wide range of applications for the mixing ratios of the two components depending on the properties which are desired in each particular case. Generally, the mixing ratio will range from 80 to 40 parts by weight of the methacrylonitrile/vinylidene chloride copolymer and from 20 to 60 parts by weight of the vinylidene chloride/acrylonitrile copolymer.

The light-sensitive compounds employed include those which liberate nitrogen gas upon exposure to light, for example, diazonium compounds. It is, however, also possible to use any other compound which liberates other gases upon exposure to light.

The quality of the light-sensitive compound is not critical. The amount of diazonium salt used is, for example, generally not higher than about 20% and ranges preferably between 1 and 20%, relative to the weight of the binder.

A further understanding of the present invention may be gained from a consideration of the following examples:

EXAMPLE 1

Preparation of a copolymer of methacrylonitrile (MAN) and vinylidene chloride ($VCl_2$):

A mixture of 209 g of MAN and 193 g of $VCl_2$, the latter being stabilized with 0.015 parts by weight of hydroquinone monomethyl ether, is introduced together with 1.05 g of azo-bis-isobutyronitrile (AIBN) and 153 g of butanone, into a glass autoclave of 2 liters capacity, which has previously been flushed with nitrogen.

The autoclave is closed and heated to 100° C. while agitating.

Starting at about 80° C., addition No. 1 consisting of a mixture of 262 g of MAN, 112 l g of $VCl_2$, 9.5 g of AIBN and 153 g of butanone is introduced at a uniform rate over a period of 30 hours.

Then addition No. 2, composed of a mixture of 154 g of MAN, 3.2 g of AIBN and 70 g of butanone is introduced at a uniform rate over a period of 10 hours.

As addition No. 3, a mixture of 6.4 g of AIBN and 170 g of butanone is finally added over a period of 16 hours.

The reaction product is then allowed to cool down. Based on the monomers employed, a proportion of more than 90% of the clear, yellow, and viscous product is precipitatable with methanol. The analysis of the copolymer indicates proportions of 71% by weight of MAN and 29% by weight of $VCl_2$. The copolymer has a softening temperature (Tg) of about 85° C. The viscosity of a 20% solution of the copolymer in butanone, measured at 20° C., is 8.5 mPa·s.

The polymer solution thus obtained can be diluted with butanone to 20% by weight and homogeneously mixed in a ratio of from 1:9 up to a ratio of 9:1, with a 20% by weight solution of copolymer composed of 80% by weight of vinylidene chloride and 20% by weight of acrylonitrile (trademark SARAN® F 310). Even after standing for several days, the mixtures do not show any sign of incompatibility, such as development of two phases or the appearance of turbidity in the solutions.

Layers prepared by pouring the above-described solutions on polyethylene terephthalate films have a good adhesion after drying in a circulating air oven.

EXAMPLES 2 and 3

Preparation of copolymers of MAN and $VCl_2$ having different compositions:

Copolymers are prepared as follows according to the general procedure described in Example 1.

| | | Example 2 (in g) | Example 3 (in g) |
|---|---|---|---|
| Contents of Autoclave | $VCl_2$ | 179 | 248 |
| | MAN | 219 | 173 |
| | AIBN | 1.05 | 1.05 |
| | butanone | 153 | 153 |
| Temperature (°C.) | | 80 | 100 |
| Addition No. 1 | $VCl_2$ | 92 | 143 |
| | MAN | 276 | 243 |
| | AIBN | 9.5 | 9.5 |
| | butanone | 153 | 153 |
| Time (hours) | | 36 | 30 |
| Addition No. 2 | MAN | 136 | 96 |
| | AIBN | 3.2 | 3.2 |
| | butanone | 62 | 43.5 |
| Time (hours) | | 12 | 15 |
| Addition No. 3 | AIBN | 6.4 | 6.4 |
| | butanone | 170 | 170 |
| Time (hours) | | 23 | 25 |
| Reaction Product (in %) | | 66 | 89 |
| Composition (% by weight) | $VCl_2$ | 23 | 40 |
| | MAN | 77 | 60 |
| Softening Temperature (°C.) | | 87 | 81 |

The copolymers are miscible in any proportion in butanone with a 20% by weight solution of a copolymer comprising 80% by weight vinylidene chloride and 20% by weight acrylonitrile.

EXAMPLE 4

Manufacture of a recording material for the vesicular process:

A butanone solution which comprises as the binder a copolymer prepared according to the process described in Example 1 (Copolymer 1) mixed with a butanone solution of a copolymer comprising 80% by weight of vinylidene chloride and 20% by weight of acrylonitrile (Copolymer 2) is poured upon a polyethlylene terephthalate film.

The butanone solutions contain 20% by weight of the specified binder mixture. As the light-sensitive compound, a diazonium compound (4-morpholino-2,5-diisopropoxy-benzene-diazonium-tetrafluoroborate) which is soluble in butanone is used in an amount of 5% by weight, relative to the solid binder.

A few drops of silicone oil are added as levelling agent or flow agent, respectively.

The mixed solutions are poured upon the 100μm thick polyethylene terephthalate film in such a manner that, after drying, a layer of about 8 g/m² is obtained. Drying is effected during 90 seconds in circulating air at temperatures rising from 50° C. to 130° C.

The following Table 1 lists various binder compositions and the properties of the vesicular materials prepared therewith:

EXPLANATION OF THE TABLE

D min and D max denote the density in the image-free or fully exposed areas, developed for 2 seconds at 90° C., as measured with a Macbeth Tranmission Densitometer TD 528.

Thermal Image Stability is the remaining density of a fully exposed film web, developed for 2 seconds at 90° C., after 1 hour storage at 80° C., given in percent of the original density.

Maximum Resolution defines the number of still legible lines per mm after development at 90° C.

Image Fogging is the degree of turbidity in the non-image portion, measured after fully exposing the nonimage areas.

The film samples are prepared for measurement by subjecting them first to a developing temperature of 90° C. for a period of 2 seconds; they are then fully exposed and again heated for 20 seconds at a temperature of 50° C. The subsequently measurable turbidity is given as image fogging.

TABLE 1

| Copolymer 1 | Copolymer 2 | Weight of Layer g/m² | Gradation | Dmax | Dmin | Image Stability % | Image Fogging | rel. Exposure Time | Resolution (max.) lines/mm |
|---|---|---|---|---|---|---|---|---|---|
| 100 | — | 7,8 | 8 | 2,4 | 0,1 | 80 | 0,19 | 1 | 362 |
| 90 | 10 | 7,8 | 10 | 2,4 | 0,1 | 75 | 0,16 | 0,6 | 362 |
| 80 | 20 | 7,4 | 10 | 2,3 | 0,1 | 50 | 0,17 | 0,5 | 362 |
| 70 | 30 | 8,2 | 8 | 2,4 | 0,1 | 50 | 0,22 | 0,65 | 362 |
| 60 | 40 | 8,1 | 6 | 2,4 | 0,1 | 50 | 0,22 | 0,65 | 362 |
| 50 | 50 | 8,3 | 8 | 2,3 | 0,1 | 35 | 0,22 | 0,5 | 362 |
| 40 | 60 | 7,9 | 8 | 2,3 | 0,1 | 50 | 0,24 | 0,5 | 362 |

DISCUSSION OF RESULTS:

As is shown, an image material having a high thermal image stability and a relatively long exposure time is obtained without admixture of Copolymer 2. By adding increasing quantities of Copolymer 2, image stability is reduced until it is only about 50% at a weight ratio of 40:60. At the same time, the exposure time is shortened to about half the initial value. Image fogging increases with an increasing proportion of Copolymer 2. Transparency in the image-free portion (D min) is invariably good, and gradation is not substantially changed.

EXAMPLE 5

As described in Example 4, the copolymers according to Examples 2 and 3 are diluted with butanone to 20% by weight and mixed with 20% by weight solutions of Copolymer 2. After adding the diazonium salt and a few drops of the levelling agent, the solutions are poured upon polyester films to form layers thereon.

TABLE 2

| Copolymer according to Example No. 2 | 3 | Copolymer 2 | Image Stability % | D min |
|---|---|---|---|---|
| parts by weight | | | | |
| 70 | — | 30 | 90 | 0,12 |
| 60 | — | 40 | 50 | 0,11 |
| 50 | — | 50 | 80 | 0,11 |
| — | 70 | 30 | 40 | 0,11 |
| — | 60 | 40 | 50 | 0,12 |
| — | 50 | 50 | 35 | 0,11 |

Table 2 shows that the binder mixtures with the copolymer according to Example 3 containing a lower proportion of methacrylonitrile, exhibit a generally lower image stability.

In the examples which follow, layers are described which are subjected to an additional hardening after the conventional drying procedure. Hardening is achieved by an increased application of heat. It may be accomplished by increasing the transfer of heat to the layer, for example by contact with a hot metal surface, or by circulating hot air at higher speeds. Hardening may also be achieved by prolonging the drying period. In addition, it is also possible to raise the drying temperature, but only within the limits acceptable in view of the presence of the diazonium salt.

The foregoing measures can be used individually or in combination with one another. If defined properties of the layer are to be obtained, the degree of hardening must be very thoroughly controlled, since the properties of the layer change with the degree of hardening, as demonstrated by the following examples.

Copolymers and copolymer mixtures similar to those of Examples 1 to 5 are used for the preparation of layers in these examples in order to exemplify the changes in the properties of the layers, which are achieved by hardening.

In the present case, hardening was effected, in part by intensifying the heat transfer by increasing the airspeed in the drying oven and, in part by lengthening the drying period or by increasing the temperature in the final drying phase.

EXAMPLES 6 and 7

Copolymers of MAN and $VCl_2$ of different compositions, prepared as described in Example 1, together with an organo-tin stabilizer compound (e.g., IRGASTAB® -T9 manufactured by Ciba-Geigy):

| | | Example 6 (in g) | Example 7 (in g) |
|---|---|---|---|
| Contents of Autoclave | $VCl_2$ | 179 | 248 |
| | MAN | 219 | 173 |
| | AIBN | 1.05 | 1.05 |
| | butanone | 153 | 153 |
| | stabilizer | 2.1 | 2.1 |
| Temperature (°C.) | | 100 | 100 |
| Addition No. 1 | $VCl_2$ | 92 | 143 |
| | MAN | 276 | 243 |
| | AIBN | 9.5 | 9.5 |
| | butanone | 153 | 153 |
| | stabilizer | 2.1 | 2.1 |
| Time (hours) | | 36 | 36 |
| Addition No. 2 | MAN | 136 | 96 |
| | AIBN | 3.2 | 3.2 |
| | butanone | 62 | 43.5 |
| | stabilizer | 0.95 | 0.95 |
| Time (hours) | | 12 | 12 |
| Addition No. 3 | AIBN | 6.4 | 6.4 |
| | butanone | 170 | 170 |
| | stabilizer | 0.2 | 0.2 |
| Time (hours) | | 24 | 24 |
| Reaction Product (in % dried) | | 100 | 100 |
| Composition | $VCl_2$ | 25 | 42 |
| | MAN | 75 | 58 |

The copolymers can be dissolved in butanone and mixed in any proportion with a 20% by weight butanone solution of a copolymer comprising 80% by weight vinylidene chloride and 20% by weight acrylonitrile.

EXAMPLE 8

Manufacture of a recording material for the vesicular method, with additional hardening:

Butanone solutions which comprise as the binder a copolymer obtained according to the process described in Example 1 (Copolymer 1) mixed with a solution of a copolymer comprising 80% by weight vinylidene chloride and 20% by weight acrylonitrile (Copolymer 2) are poured on a 100 μm thick polyethylene terephthalate film.

The butanone solutions contain 20% by weight of the specified binder mixture. A diazonium compound (4-morpholino-,2,5-dimethoxy-benzene-diazonium-tetrafluoroborate) which is soluble in butanone is used as the light-sensitive compound in an amount of 5% by weight relative to the solid binder. A few drops of silicone oil are added as levelling agent.

Drying is carried out at temperatures rising from 50° C. to 130° C. in the course of 90 seconds. The layer is hardened by additional heating on a metal roll at 125° C. for a period of about 60 seconds. After drying, layers of about 6 to 7 g/m² are obtained.

In Table 3 below, different binder compositions and the properties of the vesicular materials manufactured therewith are compiled.

EXPLANATION OF TABLES 3,4 and 5

D min and D max designate the densities in the image-free and fully exposed areas, developed for 2 seconds at 110° C., measured with a Macbeth Transmission Densitometer TD 528.

Thermal Image Stability is the remaining density of a fully exposed film web, developed for 2 seconds at 110° C., after 1 hour storage at 80° C., expressed as a percent of the original density.

Image Fogging is the degree of turbitiy in the non-image portion, measured after fully exposing the non-image areas.

The film samples are prepared for measurement by fully exposing them and maintaining them at a temperature of 60° C. for 20 seconds. The turbidity which can then be measured is given as image fogging.

TABLE 3

| Copolymer 1 | Copolymer 2 | Weight of Layer g/m² | Dmax | Dmin | Image Stability % | Image Fogging | rel. Exposure Time |
|---|---|---|---|---|---|---|---|
| 100 | — | 6,6 | 2,26 | 0,12 | 93 | 0,13–0,14 | 1 |
| 90 | 10 | 6,7 | 2,34 | 0,13 | 96 | 0,16–0,17 | 0,91 |
| 80 | 20 | 6,1 | 2,33 | 0,13 | 99 | 0,17 | 1 |
| 70 | 30 | 6,4 | 2,25 | 0,14 | 99 | 0,18–0,19 | 0,91 |
| 60 | 40 | 6,6 | 2,14 | 0,13 | 97 | 0,21–0,22 | 0,91 |
| 50 | 50 | 6,5 | 2,34 | 0,15 | 91 | 0,27–0,31 | 1 |
| 40 | 60 | 6,5 | 2,29 | 0,14 | 88 | 0,22–0,24 | 1 |

EXAMPLE 9

Butanone solutions which contain as the binder a copolymer prepared according to the process described in Example 6 mixed with a solution of a copolymer comprising 80% by weight vinylidene chloride and 20% by weight acrylonitrile (Copolymer 2) are poured on a 100 μm thick polyethylene terephthalate film. The layer is dried and hardened according to the procedure described in Example 8.

In the following Table 4, different binder mixtures and the properties of the vesicular materials manufactured therewith are compiled.

TABLE 4

| Copolymer (acc. to Ex. 6) | Copolymer 2 | Weight of Layer g/m² | Dmax | Dmin | Image Stability % | Image Fogging | rel. Exposure Time |
|---|---|---|---|---|---|---|---|
| 100 | — | 7,0 | 1,67 | 0,12 | 86 | 0,11–0,12 | 0,85 |
| 90 | 10 | 7,4 | 2,38 | 0,14 | 100 | 0,18 | 0,85 |
| 80 | 20 | 6,8 | 2,18 | 0,14 | 99 | 0,16 | 1 |
| 70 | 30 | 6,7 | 2,24 | 0,14 | 94 | 0,25–0,27 | 0,77 |
| 60 | 40 | 6,5 | 2,06 | 0,15 | 92 | 0,22–0,24 | 0,85 |
| 50 | 50 | 6,6 | 2,34 | 0,17 | 83 | 0,35–0,39 | 0,85 |
| 40 | 60 | 6,4 | 2,28 | 0,13 | 80 | 0,22–0,23 | 0,77 |

EXAMPLE 10

Butanone solutions which contain as the binder a copolymer prepared according to the process described in Example 7 mixed with a solution of a copolymer comprising 80% by weight vinylidene chloride and 20% by weight acrylonitrile (Copolymer 2) are poured on a 100 μm thick polyethylene therephthalate film. After drying, the layer is hardened as described in Example 8.

Table 5 below, lists different binder mixtures and the properties of the vesicular materials manufactured therewith.

TABLE 5

| Copolymer (acc. to Ex. 7) | Copolymer 2 | Weight of Layer g/m² | Dmax | Dmin | Image Stability % | Image Fogging | rel. Exposure Time |
|---|---|---|---|---|---|---|---|
| 100 | — | 5,2 | 2,21 | 0,11 | 99 | 0,11 | 0,73–0,82 |
| 90 | 10 | 7,8 | 2,40 | 0,15 | 94 | 0,16–0,17 | 0,82–0,91 |
| 80 | 20 | 6,2 | 2,29 | 0,12 | 92 | 0,14–0,15 | 0,91 |
| 70 | 30 | 6,3 | 2,31 | 0,13 | 90 | 0,16–0,17 | 0,82 |
| 60 | 40 | 5,9 | 2,28 | 0,13 | 77 | 0,16–0,19 | 0,91 |
| 50 | 50 | 6,8 | 2,30 | 0,14 | 80 | 0,17–0,18 | 1 |

TABLE 5-continued

| Copolymer (acc. to Ex. 7) | Copolymer 2 | Weight of Layer g/m² | Dmax | Dmin | Image Stability % | Image Fogging | rel. Exposure Time |
|---|---|---|---|---|---|---|---|
| 40 | 60 | 6,7 | 2,27 | 0,13 | 77 | 0,17–0,18 | 1 |

DISCUSSION OF RESULTS

The values given in Tables 3,4 and 5 show that despite their identical or similar compositions, the hardened layers have properties which differ from the properties of the layers in Tables 1 and 2. The films must be developed at higher temperatures in order to yield sufficient contrast, however, the values of image stability and image fogging of the hardened layers are then markedly better than the corresponding values for non-hardened layers.

In practical application of the films this means that the hardening conditions can be adjusted according to the film properties desired in each case.

By modifying the copolymers of methacrylonitrile and vinylidene chloride as well as varying the mixing ratios of these copolymers with the vinylidene chloride/acrylonitrile copolymer in addition to hardening which can be effected to different degrees, a wide range of possible combinations of properties can be obtained.

The foregoing embodiments have been described merely as illustrations of the invention and are not intended to be limiting. Since modifications of the described embodiments incorporating the spirit and substance of the invention may occur to persons skilled in the art, the scope of the invention is to be limited solely with respect to the appended claims.

We claim:

1. A light-sensitive vesicular recording material comprising a support and a layer on said support comprising a binder having a light-sensitive compound dispersed therein, said light-sensitive compound decomposing to generate nitrogen gas when exposed to light, and said binder consisting of a material selected from the group consisting of:

(a) a copolymer of methacrylonitrile and vinylidene chloride soluble in butanone, and (b) a blend of a copolymer of methacrylonitrile and vinylidene chloride soluble in butanone and a copolymer of vinylidene chloride and acrylonitrile, said copolymers being miscible with each other in butanone.

2. A recording material according to claim 1 wherein said binder consists of a blend of a copolymer of methacrylonitrile and vinylidene chloride soluble in butanone and a copolymer of vinylidene chloride and acrylonitrile; said copolymers being miscible with each other in butanone.

3. A recording material according to claim 2 wherein said binder comprises from about 80 to about 40 weight percent of a copolymer of methacrylonitrile and vinylidene chloride and from about 20 to about 60 weight percent of a copolymer of vinylidene chloride and acrylonitrile.

4. A recording material according to claim 1 wherein said copolymer of methacrylonitrile and vinylidene chloride comprises from about 80 to about 40 weight percent methacrylonitrile and has a glass transition temperature (Tg) in the range from about 80° to about 130° C.

5. A recording material according to claim 1 wherein said copolymer of methacrylonitrile and vinylidene chloride has a solution viscosity less than about 50 mPa.s measured in a 20% solution in butanone at 20° C.

6. A recording material according to claim 5 wherein said copolymer of methacrylonitrile and vinylidene chloride has a solution viscosity in the range from about 2.5 to about 30 mPa.s measured in a 20 percent solution in butanone at 20° C.

7. A recording material according to claim 6 wherein said copolymer of methacrylonitrile and vinylidene chloride has a solution viscosity in the range from about 5 to about 15 mPa.s measured in a 20 percent solution in butanone at 20° C.

8. A recording material according to claim 2,3,4 or 5 wherein said binder comprises a mixture of 45 parts by weight of a copolymer of 70 weight percent methacrylonitrile and 30 weight percent vinylidene chloride and 55 parts by weight of a copolymer of 80 weight percent vinylidene chloride and 20 weight percent acrylonitrile.

9. A recording material according to claim 2,3,4 or 5 wherein said binder comprises a mixture of 60 parts by weight of a copolymer of 77 weight percent methacrylonitrile and 23 weight percent vinylidene chloride and 40 parts by weight of a copolymer of 80 weight percent vinylidene chloride and 20 weight percent acrylonitrile.

10. A recording material according to claim 2,3,4 or 5 wherein said binder comprises a mixture of 80 parts by weight of a copolymer of 70 weight percent methacrylonitrile and 30 weight percent vinylidene chloride and 20 parts by weight of a copolymer of 80 weight percent vinylidene chloride and 20 weight percent acrylonitrile.

11. A recording material according to claim 2,3,4 or 5 wherein said binder comprises a mixture of 40 parts by weight of a copolymer of 75 weight percent methacrylonitrile and 25 weight percent vinylidene choride and 60 parts by weight of a copolymer of 80 weight percent vinylidene chloride and 20 weight percent acrylonitrile.

12. A recording material according to claim 2,3,4 or 5 wherein said binder comprises a mixture of 80 parts by weight of a copolymer of 60 weight percent methacrylonitrile and 40 weight percent vinylidene chloride and 20 parts by weight of a copolymer of 80 weight percent vinylidene chloride and 20 weight percent acrylonitrile.

13. A recording material according to claim 1 wherein said support comprises a material selected from the group consisting of synthetic polymer films, paper, metal foils, metal plates and glass plates.

14. A recording material according to claim 13 wherein said support comprises a polyethylene terephthalate film.

15. A recording material according to claim 1 wherein said light-sensitive compound is a diazonium compound which decomposes and generates nitrogen gas when exposed to light.

16. A recording material according to claim 15 wherein said diazonium compound is 4-morpholino-2,5-diisopropoxy-benzene-diazonium-tetrafluoroborate.

17. A recording material according to claim 1 wherein said light-sensitive compound is present in an amount equal to from about 1 to about 20 percent of the weight of said binder.

18. A recording material according to claim 1 wherein said binder layer is hardened by subjecting the layer to heat after drying.

19. A recording material according to claim 18 wherein said binder layer is hardened by heating the layer to a temperature in the range from about 90° to about 130° C.

20. A recording material according to claim 1 wherein said binder further comprises a stabilizer for inhibiting decomposition of vinylidene chloride to form hydrogen chloride.

21. A recording material according to claim 20 wherein said stabilizer is an organo-tin compound.

* * * * *